United States Patent [19]

Yokoyama

[11] 4,283,927

[45] Aug. 18, 1981

[54] HAND-OPERATED KNITTING MACHINE WITH LOOP TRANSFER FUNCTIONS

[75] Inventor: Nobuaki Yokoyama, Kodaira, Japan

[73] Assignee: Silver Seiko, Ltd., Kodaira, Japan

[21] Appl. No.: 80,149

[22] Filed: Sep. 28, 1979

[30] Foreign Application Priority Data

Oct. 17, 1978 [JP] Japan ..... 53-126854

[51] Int. Cl.[3] ..... D04B 7/00; D04B 15/36; D04B 35/00

[52] U.S. Cl. ..... 66/78

[58] Field of Search ..... 66/60 H, 60 R

[56] References Cited

U.S. PATENT DOCUMENTS

| | | | |
|---|---|---|---|
| 3,412,582 | 11/1968 | Kitazawa | 66/70 |
| 3,861,174 | 1/1975 | Kunisada et al. | 66/60 |

FOREIGN PATENT DOCUMENTS

| | | | |
|---|---|---|---|
| 42-16356 | 9/1967 | Japan | 66/60 |
| 49-31950 | 3/1974 | Japan | 66/60 |
| 534992 | 3/1941 | United Kingdom | 66/60 |
| 1362421 | 8/1974 | United Kingdom | 66/60 |
| 1435165 | 5/1976 | United Kingdom | 66/60 |

*Primary Examiner*—Ronald Feldbaum

*Attorney, Agent, or Firm*—Lane, Aitken, Kice & Kananen

[57] ABSTRACT

A hand-operated knitting machine of the type having a single, flat needle bed includes an improved carriage mounted on the bed for bi-directional movement. The carriage performs the needle selection, loop transfer, and knitting functions through a cam arrangement symmetrically located relative to the transverse center line of the carriage. The cam arrangement includes the plurality of fixed and movable cams that define front and rear loop transfer butt-paths that operatively engage the transferring and the receiving needles of a given set of paired needles to cause them to cooperate with a loop transfer device to effect loop transfer from one to the other of the needles to knit a lace-form fabric.

8 Claims, 18 Drawing Figures

HAND-OPERATED KNITTING MACHINE WITH LOOP TRANSFER FUNCTIONS

BACKGROUND OF THE INVENTION

This invention relates to a hand-operated knitting machine of the type having a single, flat needle bed that includes a plurality of knitting needles tricked in the bed for individual movement therein and, more particularly, to a hand-operated knitting machine which has a carriage that performs loop transfer functions whereby a lace stitch or open work can be knitted on the knitting machine.

A knitting machine carriage with loop transfer functions has been proposed by means of which one or more needle loops on selected knitting needles in a single needle bed are transferred, during directional movement of the carriage on the needle bed, onto those knitting needles in the same needle bed which are in an adjacent, paired relationship to the selected knitting needles. Conventionally, a knitting machine provided with such a loop transfer carriage includes a main knitting carriage that includes a cam mechanism for actuating the knitting needles to knit a desired plain or color designed fabric with one or more yarns fed thereto through a yarn feeder mounted on the knitting carriage. In knitting a lace stitch, the knitting carriage is repetitively operated to knit rows or courses of plain stitches until a preselected row of stitches is reached in which loop transfer is to be effected to form openings or eyelets in the fabric to be knitted, whereupon needle selection is carried out manually or automatically by a suitable means provided with the machine. Thereafter the loop transfer carriage is slidably moved along the bed to effect the desired transfer of the needle loops from the selected needles to their respective paired needles adjacent thereto.

The loop transfer carriage typically has a generally symmetrical construction relative to the transverse center line thereof for its bidirectional operations as in the conventional knitting carriage, and includes, for each direction of operation, a loop transfer device adapted to cooperate with a selected needle and an adjacent, paired needle at their forward end portions to carry out the transfer of a needle loop from the selected transferring needle to the paired receiving needle adjacent thereto. The carriage also includes a cam mechanism which defines first and second loop transfer butt-paths for actuating, respectively, the selected and the unselected remaining needles to bring the selected needles and the adjacent paired needles into operative engagement with the loop transfer device to effect the desired loop transfer operations. Loop transfer carriages of such general construction are disclosed in U.S. Pat. No. 3,412,582 and No. 3,861,174; and British Pat. No. 1,362,421. Such knitting machines provided with these loop transfer carriages are not provided with additional special means to assist in effecting loop transfer, such as, for example, a rigid loop expander secured to each knitting needle. While loop expanders of this type are typically employed in conventional industrial double-bed knitting machines that perform loop transfer functions, they are not employed in hand-operated home knitting machines because of their relatively high cost.

For convenient use, the loop transfer carriage is conventionally provided with a suitable means to enable the placement of the carriage at any desired position on the needle bed from above and to enable removal therefrom while the knitting carriage can be placed on the needle bed only at the longitudinal ends of the needle bed. Also, in knitting machines of this type, an extension rail member is removably mounted on each longitudinal end of the needle bed so that the loop transfer carriage can be temporarily mounted on either one of the extension rails in order to prevent the loop transfer carriage from interfering with the movement of the knitting carriage on the needle bed.

A knitting machine carriage has also been proposed which is provided with knitting and loop transfer functions incorporated therein in order to simplify and facilitate the operation of the machine in knitting a lace stitch thereon. The carriage consists of a major part on which all the elements for the ordinary knitting functions are mounted and a pair of minor parts which are removably attached to the opposite longitudinal ends of the major part and correspond substantially to the opposite half-sections of the aforementioned loop transfer carriage. Each minor part carries all the elements that constitute the loop transfer device and the associated loop transfer cam mechanism. When loop transfer is to be effected, needle selection is first carried out manually or by any other suitable means, and then the combined carriage is operated to effect the desired loop transfer and the subsequent knitting of a row of stitches with a supplied yarn.

A knitting machine carriage according to a further proposal is provided with, in addition to the knitting and loop transfer functions, needle selection functions in order to further simplify and facilitate the operation of the machine. The needle selector cams or members are located outside the loop transfer cam mechanism on the carriage, adjacent to the longitudinal outer ends of the carriage. Needle selection, loop transfer, and knitting can be effected in order as desired by a simple operation of the machine, that is, by the directional sliding operation of the carriage on the needle bed.

In designing a carriage for a hand-operated home knitting machine which is manually operated by, in most cases, a housewife or a young woman, special attention must be paid to the weight, size, and especially the length of the carriage taken along the needle bed to provide a carriage that is convenient to use. In the case of an ordinary hand-operated home knitting machine currently on sale, its knitting carriage, which normally includes a pair of needle selector members or cams and a knitting cam mechanism for knitting a two color patterned fabric with two simultaneously supplied yarns is about 30 cm. long and weighs about 2.3 kg, while the overall length of the machine is about 112 cm. Meanwhile, a conventional loop transfer carriage has a length of at least about 22 cm. Accordingly, incorporation of the loop transfer functions of the loop transfer carriage into the knitting carriage would provide the carriage with the total length of up to 52 cm., which is about 173% the length of the original knitting carriage and about one-half the overall length of the knitting machine, although such length can be decreased to a degree by simplification of the knitting cam mechanism such that it is adpated for a plain stitch with a single yarn supply.

SUMMARY OF THE INVENTION

Accordingly, it is an overall object of the present invention to provide a hand-operated knitting machine having a single, flat needle bed and a cooperating carriage that is provided with needle selection, loop transfer, and knitting functions so as to enable a lace stitch to be knitted on the machine in which the carriage is of a reasonable size including a length that is comparable to the length of the knitting carriage of a conventional home knitting machine to facilitate convenient manipulation and operation of the carriage.

A hand-operated knitting machine according to one aspect of the present invention comprises a pair of loop transfer devices located on said carriage in a symmetrical relationship with each other relative to the transverse center line of said carriage and cooperable with a given set of paired needles at the forward end portions thereof to transfer a particular needle loop from one to the other of the paired needles;

a yarn feeder mounted on said carriage and having an eye for feeding therethrough a knitting yarn onto said needles; and a cam arrangement mounted on said carriage for engagement with the butts of said needles to actuate said needles and having a generally symmetrical construction relative to said center line, said cam arrangement including a pair of needle selector members each located adjacent to an end portion of said carriage, a pair of cam member set each located inwardly of an associated needle selector member in opposing relationship to an associated loop transfer device and each defining first and second loop transfer butt-paths for actuating, respectively, the needles selected by said needle selector members and the unselected remaining needles to bring the selected needles, as transferring needles and those of the unselected needles which are paired with the selected needles, as receiving needles, into operative engagement with said loop transfer devices to effect transfer of the particular needle loops from said selected transferring needle to said unselected, paired, receiving needle of each needle pair, a center raising cam having a pair of cam profiles each defining part of a raising butt-path for raising both the selected and unselected needles to their clearing position, the raising butt-paths being contiguous to the respective first and second loop transfer buttpaths defined by the respective cam sets and intersecting each other at a point adjacent the forward angular end of the center raising cam, each set of said cams defining the remaining part of the corresponding raising butt-path, and a part of a lowering butt-path for lowering said needles from the clearing position to beyond the knock-over position, the lowering butt-path being contiguous to its respective raising butt-path, a knitting yarn being fed to the knitting needles while the needles are being lowered along said lowering butt-paths so as to be knit into needle loops by said needles, and a pair of knitting cams each located rearwardly of said first and second loop transfer butt-paths defined by the associated cam member sets for intersecting, in a first direction of movement of said carriage, one of said lowering butt-paths for the other direction of movement whereas said first and second butt-paths for the other direction of movement intersect the other lowering butt-path for said first direction of movement.

A hand-operated knitting machine according to another aspect of the present invention comprises first and second loop transfer devices located on said carriage in a symmetrical relationship with each other relative to the transverse center line of said carriage and cooperable with a given pair of needles at the forward end portions thereof to transfer a particular needle loop from one to the other of said paired needles;

a yarn feeder mounted on said carriage and having an eye for feeding therethrough a knitting yarn onto said needle; and a cam arrangement mounted on said carriage for engagement with the butts of said needles to actuate said needles and having a symmetrical construction relative to said center line, said cam arrangement including first and second needle selector members each located adjacent to an end portion of said carriage for selecting needles, respectively, during movement of said carriage in said first direction and in said second direction, first and second cam member sets located, respectively, inwardly of said first and second needle selector members in opposing relationship to said first and second loop transfer devices, said first cam member set defining first and second loop transfer butt-paths for said first direction of movement of said carriage and said second cam member set defining first and second loop transfer butt-paths for said second direction of movement of said carriage, each of said first and second loop transfer butt-paths for their respective direction of movement actuating the needles selected by the associated needle selection member and the unselected remaining needles which are paired with the selected needle into operative engagement with the associated loop transfer device to effect transfer of the particular needle loops from said selected to said unselected paired needles, a center raising cam member having a pair of cam profiles each defining part of a first and a second raising butt-path that are contiguous to the first and second loop transfer butt-paths for the respective first and second directions of movement of said carriage, both raising butt-paths intersecting each other adjacent the forward angular end of said center raising cam, the remaining part of said first raising butt-path being defined by said second cam member set and the remaining part of said second raising butt-path being defined by said first cam member set, said second cam member set defining, contiguous to said first raising butt-path, part of a first lowering butt-path for lowering said needles from the clearing position to beyond the knock-over position, said first cam member set defining, contiguous to said second raising butt-path, part of a second lowering butt-path for lowering said needles from the clearing position to beyond the knock-over position, a knitting yarn being fed through said yarn feeder to the knitting needles when they are lowered along said first and said second lowering butt-paths so as to be knit into needle loops by said needles, first and second knitting cams located rearwardly, respectively, of said first and second loop transfer butt-paths for said first direction of movement and said first and second loop transfer butt-paths for said second direction of movement, said first knitting cam intersecting said second lowering butt-path during movement of said carriage in said second direction and said second knitting cam intersecting said first lowering butt-path during movement of said carriage in said first direction, said first and said second loop transfer butt-paths for said first direction of movement of said carriage intersecting said second lowering butt-path and said first and second loop transfer butt-paths for said second direction of movement of said carriage intersecting said first lowering butt-path.

BRIEF DESCRIPTION OF THE DRAWINGS

The above description, as well as the objects, features, and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENTS

Figure 12:
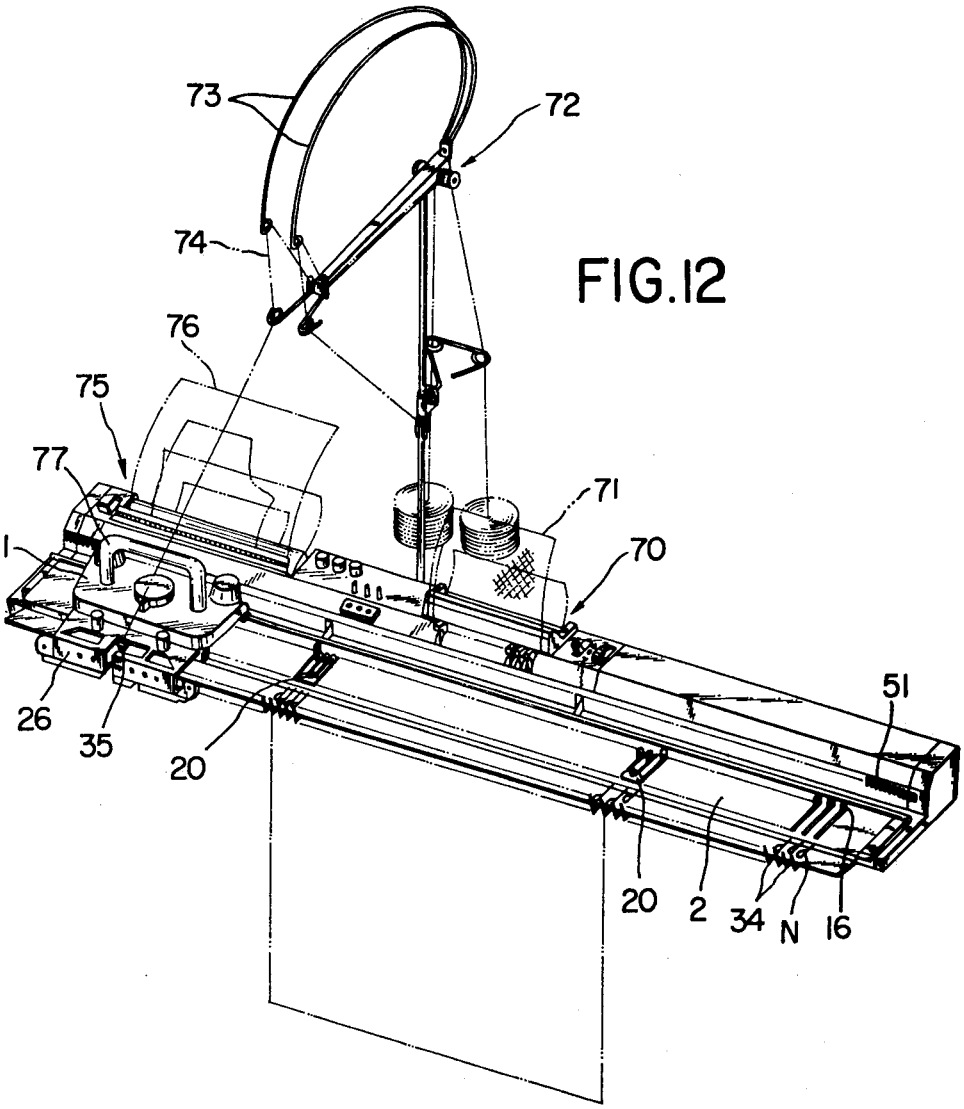
FIG. 12 is a perspective view of a knitting machine embodying the present invention showing the carriage mounted on a needle bed.

A hand-operated knitting machine embodying the present invention is shown generally in FIG. 12 and includes an elongated needle bed 2 having a plurality of latch-type knitting needles N tricked in the bed in a side-by-side, equi-spaced relationship for individual movement along their respective longitudinal axes. A program providing device, generally designated at 70, is centrally located behind the needle bed 2 and is adapted to removably receive a program carrier 71 in the form of a conventional punched card or sheet that includes a patterning or needle selection program defined by a plurality of punched holes arranged in rows and columns thereon. The needle selection program determines which of the knitting needles N are to be selected during the current knitting operation and which are to be left unselected. A conventional yarn take-up device, generally designated at 72, is removably mounted on the machine adjacent to the left end of the program providing device 70. The yarn take-up device 72 preferably includes two resilient take-up springs 73 for taking up the slack in a yarn or yarns designated at 74. A conventional fashioning or knitting width indicator generally designated at 75, is provided adjacent to the left end of the machine behind the needle bed 2. The knitting width indicator 75 determines the knittng width, or in other words, the knitting needles N which are to be operated during the current knitting operation and those which are to be left inoperative. A pattern paper 76 is removably mounted on the knitting width indiator 75 and carries thereon a pattern, that is, a contour or profile of the part of the garment to be knitted on the machine.

A carriage 1 is mounted on the needle bed 2 for sliding back and forth movement along the longitudinal axis of the machine and includes a handle 77 attached thereto for manual gripping thereof by a machine operator. The carriage 1 has a generally symmetrical construction about a transverse center line 7 (see FIG. 1) that generally is perpendicular to the longitudinal axis of the machine. The carriage 1 is bidirectionally operative and is provided with knitting, loop transfer, and needle selection functions described in more detail below.

Figure 1:
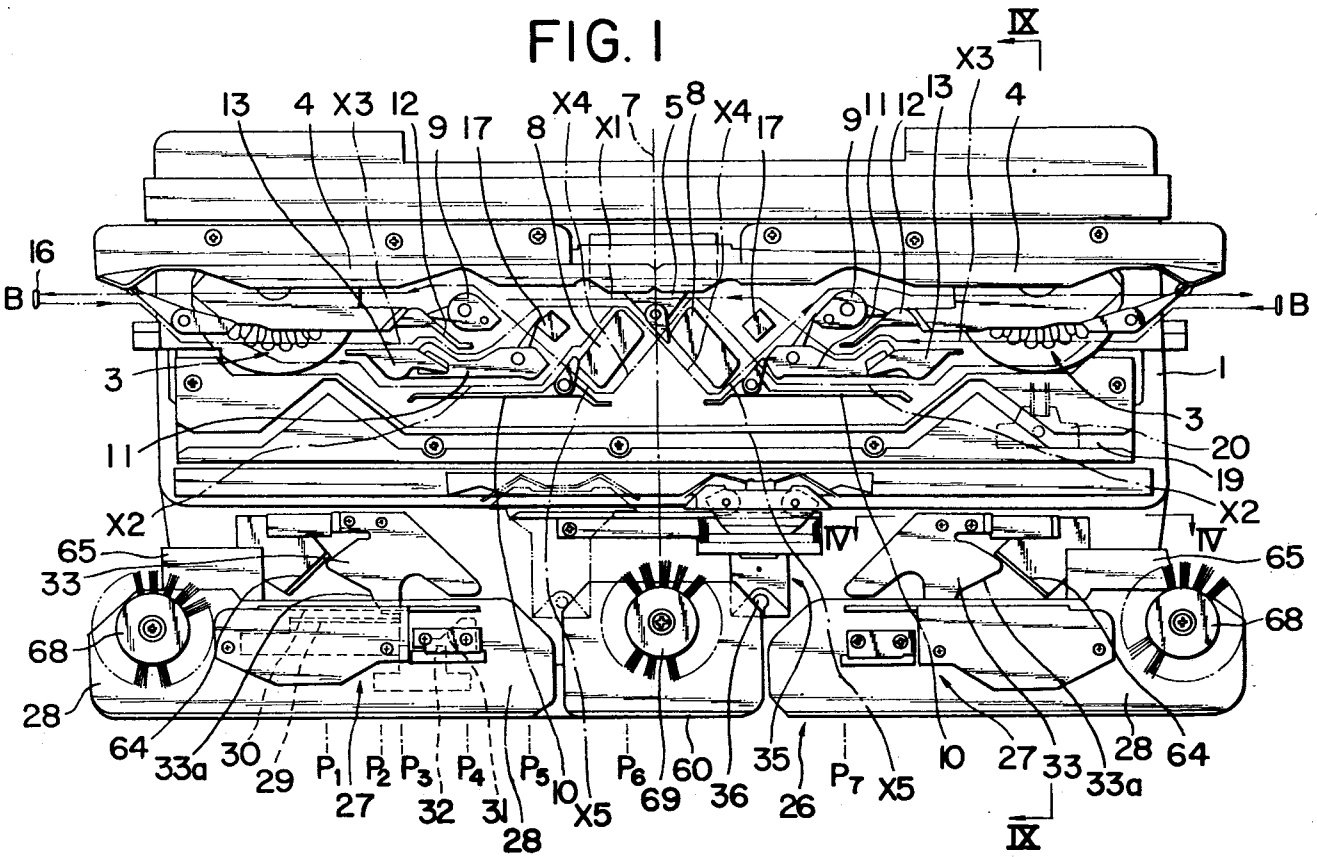
FIG. 1 is a bottom plan view of a carriage of a hand-operated knitting machine embodying the present invention.

As shown in FIG. 1, the carriage 1 is provided with a yarn feeder generally designated at 35, mounted thereon for feeding a knitting yarn to the needles N in the needle bed 2, and a pair of loop transfer devices, each generally designated at 27, located in a symmetrical relationship with each other relative to the center line 7 and cooperable with the forward end portions of a set of adjacent, paired needles to transfer a particular needle loop suspended from one of the paired needles to another of the paired needles to effect the desired lace-form knitting. The carriage 1 has, on the bottom thereof, a needle actuating cam arrangement defined by a plurality of fixed and adjustable cam surfaces, described more fully below, that establish various butt-paths for the butts 16 (FIG. 9) of the knitting needles N. The needle actuating cam arrangement actuates the knitting needles N to knit a yarn fed from the yarn feeder 35 into needle loops and also actuates the needles N to cooperate with the loop transfer devices 27 to effect the desired loop transfer of one or more of the knitted loops. The needle actuating cam arrangement is shown in detail in FIG. 10 and in its assembled relationship with the knitting carriage structure in FIG. 1. The needle actuating cam arrangement includes a rear partition cam 4 and a front partition member 18 both of which extend along the full length of the carriage 1 and define rearward and forward limits of movement, respectively, of the operative needles N by cam members on the carriage 1. The rear partition cam 4 is so positioned on the carriage 1 to allow the butts 16 of the inoperative needles N, which are in their most lowered or retracted position, to pass rearwardly thereof as shown in phantom in FIG. 9. The other cams forming the needle actuating cam arrangement are disposed between the rear partition cam 4 and front partition member 18.

A triangular center cam 5 is located adjacent to the rear partition cam 4 on the center line 7 of the carriage 1 and has a pair of raising or advancing cam profiles or edges disposed symmetrically to each other relative to the center line 7. The center cam 5 is shiftably mounted so that it can be shifted between an initial, operative position as shown in full-line illustration in FIGS. 1 and 10 and a shifted, inoperative position as shown in phantom in FIG. 10 by means of a suitable control mechanism (not shown) known in the art. In the alternative, the cam 5 may be of the movable bolt type so that it can be either projected into a operative position or withdrawn into an inoperative position. A swing cam or gate 6 is mounted for pivotal motion about a pivot 5*a* secured to the center cam 5 adjacent its forwardly facing, apical end at which end both cam edges of the center cam 5 converge toward and meet with one another.

A pair of fixed superior cams 8 are located adjacent to the center cam 5 in symmetrical relationship to each other relative to the center line 7. Each superior cam 8 has a substantially rectangular configuration and is disposed obliquely relative to the center line 7 to provide to outer lowering cam edge 8*a* and an inner raising cam edge 8*b*. The pivotally mounted gate 6 of the center cam 5 is adapted to pivot such that its distal end can alternatively contact the inwardly facing corner of each of the superior cams 8. A fixed inferior cam 17 is located in a position spaced from and opposite to the lowering cam edge 8*a* of each superior cam 8 and has a substantially square configuration oriented in a similar oblique disposition or attitude as its adjacent superior cam 8 to provide a rearwardly facing lowering cam edge.

A front partition cam 10 extends in parallel relationship with the front partition member 18 from a point in front of and spaced apart from the forward end of each superior cam 8. The partition cam 10 has a rearwardly extending nose 10*a* formed near its inner end, and a swing cam or gate 14 pivotally mounted on a pin 10*b* secured to the nose 10*a* of the partition cam 10. Each swing cam 14 is pivotable between an inner position in which its distal end abuts or contacts the outer end of the superior cam 8 and an outer position in which its distal end abuts or contacts the inner end of an intermediate cam 11. The intermediate cam 11 is disposed generally in a spaced apart, parallel, and coextensive relationship with the front partition cam 10. A separator cam 13 is positioned at the outer end of the intermediate cam 11 and may preferably be formed therewith as a single block cam. Another swing cam or gate 15 is mounted for pivotal motion about a pin 11*a* secured to the intermediate cam 11 near the end thereof. The swing cam 15 is pivotable between an inner position in which its distal end abuts or contacts the outer end of the inferior cam 17 and an outer position in which its distal end abuts or contacts the inner end of a stitch cam 9 located behind and spaced rearwardly of the intermediate cam 11. The stitch cam 9 has an inner lowering or knitting cam edge and is adjustable in a direction towards and away from the rear partition cam 4 by means of a conventional adjusting means (not shown) in order to adjustably determine the stitch size of the fabric to be knitted on the machine. Thus, the stitch cam 9 is movable between front and rear limit positions as shown in phantom on the right-hand side of FIG. 10. An auxiliary cam or gate 9*a* is pivotally mounted on a pin 9*b* secured to the stitch cam 9 and is resiliently urged by a spring (not shown) to cause its distal end to abut or contact the rear surface of a rear cam 12 to provide an outer lowering cam edge for lowering the needles to a position determined by the adjustable stitch cam 9. The rear cam 12 extends substantially along the outer half of the intermediate cam 11 and is disposed obliquely relative to the center line 7 to provide an outer raising cam edge. The rear cam 12 is contiguous, at its outer end, with an inner extension 43*a* of a base plate 43 that supports a needle selector cam or member 3 which determines the needles for which the loop transfer operation is to be effected.

Figure 9:
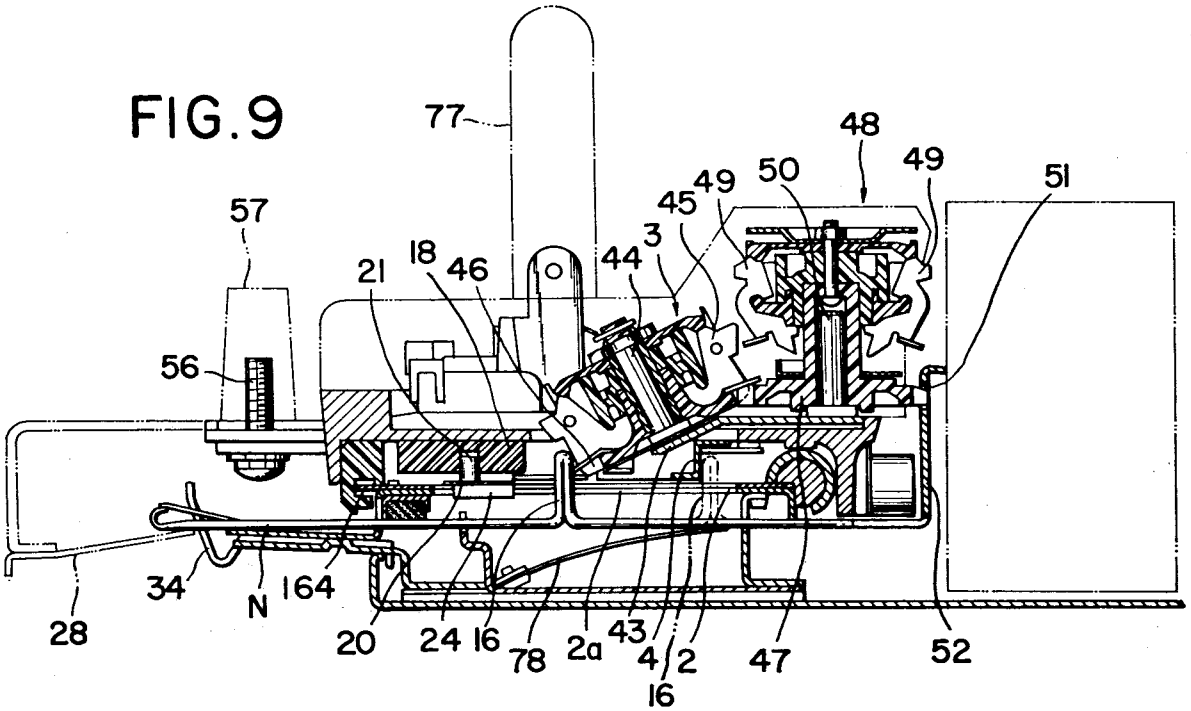
FIG. 9 is a cross-sectional elevational view taken along line IX—IX of FIG. 1, showing a needle selector unit on the carriage acting on a knitting needle in the needle bed.
Figure 10:
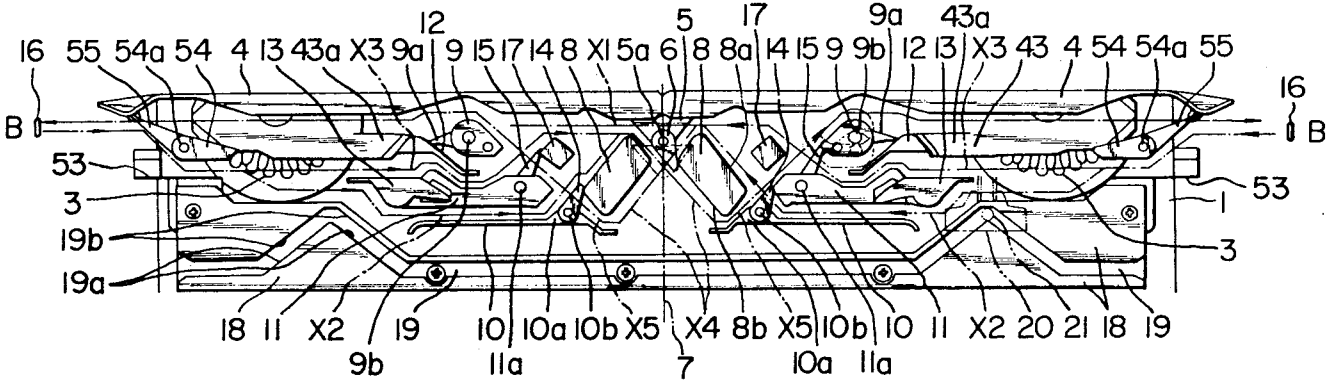
FIG. 10 is a partial bottom view of the carriage of FIG. 1, showing the cam arrangement of the carriage.

While any type of needle selection means, for example, an electromechamically actuated needle selector cam, which is mountable on the carriage and adapted to engage the butts 16 of the knitting needles N to select needles in accordance with a given needle selection program can be employed for a needle selector cam or member, the preferred embodiment of the invention employs a needle selector member in the form of a mechanical data storage drum 3 of a type known in the art. As shown in FIGS. 1 and 10, the data storage drums 3 are located adjacent each end of the carriage 1, and, as shown in FIG. 9, each drum 3 is mounted for rotation about an inclined shaft 44 secured to a forward extension of the base plate 43 which extends downwardly and forwardly through an opening formed in the carriage 1 to allow the drum 3 to selectively act upon the butts 16 of the knitting needles N to effect the desired needle selection. The drum 3 has thereon a predetermined number of settable elements or tiltable levers 45 and a gear 46 secured thereto which is in meshing engagement with another gear 47 secured to another drum, generally designated at 48. The drum 48 includes the predetermined number of settable elements or tiltable levers 49 thereon and is supported for rotation about an upright shaft 50 secured to the base plate 43. The gear 47 of the drum 48 is normally in meshing engagement with a rack-like element 51 formed on a rear upright wall section 52 of the needle bed 2. As the carriage 1 is moved back and forth along the needle bed 2 the drum 48 and hence the drum 3 are caused to rotate about their respective shafts 50 and 44.

When the drum 48 passes the program providing device 70 (FIG. 12) alongside the needle bed 2 during movement of the carriage 1 along the needle bed 2, the settable element 49 of the drum 48 are set in a manner determined by the appropriate row of needle selection data on the program carrier 71 on the device 70. The data thus stored on the drum 48 are then transferred or transmitted to and stored in the tiltable levers 45 of the selector drum 3. The selector drum 3 thus set selects, during a subsequent movement of the carriage in the reverse direction, knitting needles N in accordance with the settings thereof or needle selection data stored thereon. Thus, some of the knitting needles N are selectively pushed or displaced forwardly a predetermined distance by the set levers 45 of the drum 3 while the remaining needles are not selected and remain in their lowered positions.

As shown in FIG. 10, a pair of spaced parallel cams 53 and 54 are located outwardly of each needle selector drum 3 and cooperatively define therebetween a butt-path in the form of a channel or track for preventing undesirable spontaneous movement of the knitting needle N in their longitudinal direction. A pivotal check cam or gate 55 is pivotally mounted on a pin 54*a* secured to the rear parallel cam 54. The check gate 55 is resiliently urged by a torsion spring (not shown) wrapped around the pin 54*a* and having its opposite ends hooked to the carriage 1 and the check cam 55 to cause the distant end of the check cam 55 to normally abut or contact an outer extension of the rear partition cam 4 to provide an outwardly facing raising cam edge.

During movement of the carriage 1 along the longitudinal axis of the needle bed 2, the needle butts 16 are first engaged by the first check cam 55 and raised or advanced by and along its outwardly facing raising edge. As shown in FIG. 1, a conventional round brush 68 is rotatably mounted on a pressor plate 28 in a position that corresponds to the position of the check cam 55 to prevent the needle loops of the knitted fabric from moving forwardly together with the needles N being raised by the check cam 55. As defined herein, the term "first" denotes the first cam that meets or contacts the needle butts 16 during movement of the carriage 1 in a selected direction relative to the needle bed 2, and the term "second" denotes the other, like cam that subsequently meets with or contacts the needle butts 16. After being raised by the outwardly facing raising edge of the check cam 55, the needle butts 16 are then brought into operative engagement with the first needle selector member 3 which then separates the needles N into first and second groups. As shown in FIG. 10, the needle butts 16 of the first selected group will thereafter follow a front loop transfer butt-path designated as X2 while the remaining non-selected needle butts 16 of the second group will follow a rear loop transfer butt-path designated as X3.

In the front loop transfer butt-path X2, the needle butts 16 of the first group are raised beyond their clearing positions by an outer raising cam edge of the separator cam 13 and then held at this raised position between the substantially confronting surfaces of the front partition cam 10 and the intermediate cam 11 until they are lowered beyond their knock-over position by a lowering cam means defined by the nose 10*a* of the first front partition cam 10, the first front swing cam 14, and the outwardly facing lowering cam edge 8*a* of the first superior cam. Concurrently with the controlled movement of the needle butts 16 of the first group, the needle butts 16 of the second group in the rear loop transfer butt-path X3 are first lowered a short distance by an outwardly facing surface of a nose of the first intermediate cam 11 and then raised forwardly by the rear cam 12 and thereafter are lowered beyond their knock-over position by a lowering cam means defined by an inner nose of the first intermediate cam 11, a lowering cam surface of the first rear swing cam 15, and the outer lowering cam edge of the first inferior cam 17. As shown in FIG. 10, the front and rear loop transfer butt-paths X2 and X3 intersect and coincide with one another at a position adjacent to the rearwardly facing end of the first superior cam 8.

Subsequently, the needle butts 16 of both the first and second groups are raised beyond their clearing position along a clearing butt-path designated at X4 and defined by the first raising cam edge of the center cam 5, the first raising edge of the center gate 6, and the inwardly facing raising cam edge 8*b* of the second superior cam 8 so that the knitting needles N have their needle loops suspended on their stem portions. The needle butts 16 are then lowered beyond their knock-over position along a knitting butt-path designated at X5 and defined by the nose 10*a* of the second front partition cam 10, the inner edge of the second front swing cam or gate 14, the inner nose of the second intermediate cam 11, the inner edge of the second rear swing cam or gate 15, and the stitch cam 9. Concurrently, the knitting needles N are fed with a yarn, such as yarn 74 (FIG. 12), fed thereon through the yarn feeder 35 (FIG. 1) so that the yarn 74 is knit into fresh needle loops on and by the needles N and with the stitch size determined by the position of the adjustable stitch cam 9 with their old loops knocked over therefrom. The needle butts 16 are thereafter allowed to substantially remain in their operative rearmost position as designated by reference line B in FIG. 10. As the needle butts 16 clear the carriage 1, they push open the second check cam 55 against the urging of the aforementioned torsion spring with the needle butts 16 being thereby normally placed in their operative rearmost position. As shown in FIGS. 1, 2, 3, and 9, the aforementioned yarn feeder 35 and the loop transfer devices 27 are mounted on a mounting member or support bracket generally designated at 26. The bracket 26 is removably mounted on the carriage 1 with a pair of upright, spaced apart threaded fasteners 56 secured to the carriage 1 and manually operable clamping nuts 57 as is conventional in the art. The bracket 26 has a pair of arms 26*c* which extend first forwardly from its base portion 26*d* and then downwardly. The pressor plate 28 is secured to a rearwardly extending flange at the lower end of the downwardly extending section of each arm 26*c*. The bracket 26 has a center extension 26*e* which extends from the right side of its arm 26*c* and terminates adjacent to but spaced from the left arm 26*c* to provide a suitable clearance gap 59 therebetween as particularly shown in FIG. 2, in order to facilitate lateral insertion and removal of a yarn into and from an eye 36 of the yarn feeder 35. A minor pressor plate 60 (FIGS. 1 and 3) is attached to a flange at the lower end of the center extension 26*e*. As described more fully below, most of the members or parts mounted on the bracket 26 are located in a spacing defined between the bracket 26 and the pressor plates 28 and 60 and the needle bed 2 while some parts are located below the pressor plates 28 and 60. The yarn feeder 35 is located in the above-defined spacing and includes a rear end disposed adjacent to the forward end of the carriage 1. The yarn feeder 35 extends horizontally forward and is then inclined in a forward and upward direction and then again in a horizontally forward direction below the base portion 26*d* of the bracket 26. The yarn feeder 35 is further bent vertically downward and has a rearward extension or flange at the lower end of the vertical section in which the eye 36 is formed. The yarn feeder 35 is movably mounted on the bracket 26 for guided movement between predetermined limits in a direction generally parallel to the longitudinal axis of the needle bed 2. A roller 37, having a circumferential groove formed on its outer periphery, is rotatably mounted on the upper horizontal section of the yarn feeder 35 by means of a suitable pin. A pair of similar rollers 38 are also rotatably mounted on the lower horizontal section of the yarn feeder 35 in a similar manner.

Figure 2:
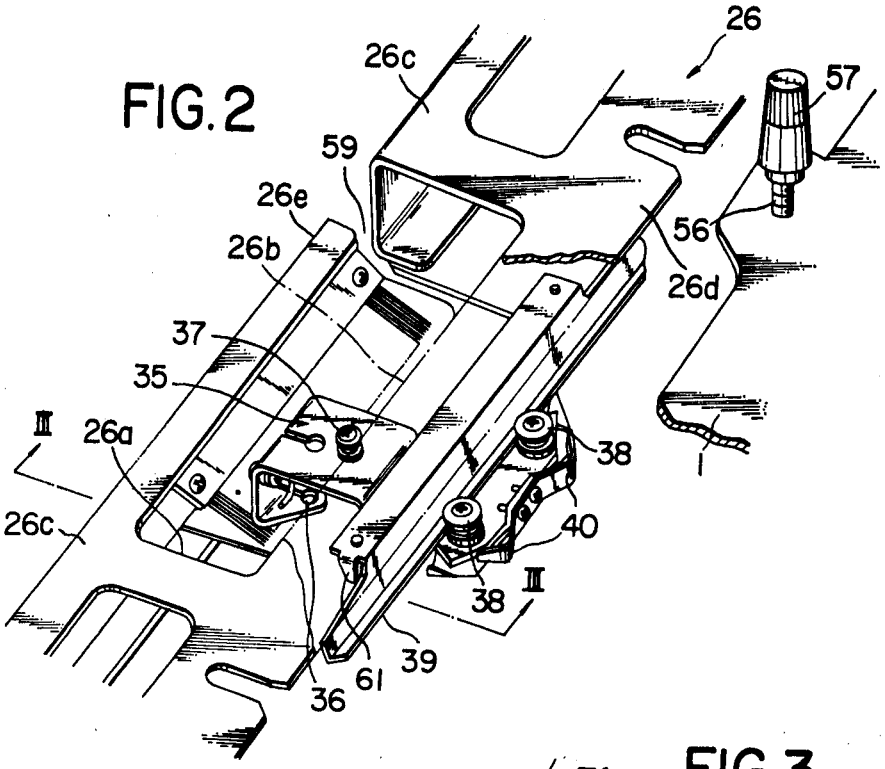
FIG. 2 is a partial, enlarged perspective view of the front portion of the carriage of FIG. 1 with selected portions thereof broken away for reasons of clarity.
Figure 3:
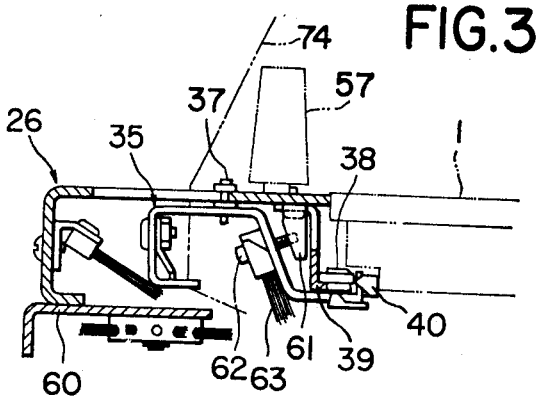
FIG. 3 is a vertical cross-sectional view of the front portion of the carriage shown in FIG. 2 taken along line III—III of FIG. 2.

The front edge 26*b* of the base portion 26*d* of the bracket 26 in the mid-section thereof is received within the circumferential groove of the roller 37 while a rear edge of a guide rail member 39, which is mounted centrally under the base portion 26*d* of the bracket 26 and has a substantially L-shaped side elevation, is received within the circumferential grooves of the rollers 38 to support the yarn feeder 35 for smooth, guided movement in a direction perpendicular to the center line 7 of the carriage 1. The movement of the yarn feeder 35 is limited by a pair of abutment members defined by depending lugs 61 (only one of which is shown in FIG. 2) formed at opposite longitudinal ends of the top of the rail member 39. The movement of the yarn feeder 35 is arrested when the distal end of a fastening screw 62 (FIG. 3) that secures a brush 63 to the upwardly inclined portion of the yarn feeder 35 contacts one of the lugs 61. Thus during movement of the carriage 1 in either direction, the yarn feeder 35 is allowed to assume a position in which a yarn is fed or released from the eye 36 of the yarn feeder 35 in an optimum condition to ensure the catching of the yarn by the hooks of those knitting needles N which are being lowered along the aforementioned knitting butt-path X5 (FIG. 10).

The yarn feeder 35 has a brake member 40 mounted at the rear end thereof. The brake member 40 has a pair of rearwardly facing curved arms adapted to resiliently and frictionally engage the front edge of a top plate 164 (FIG. 9) of the needle bed 2 so that upon reverse movement of the carriage 1 the yarn feeder 35 is brought to the lug-limited position at the trailing end of its path relative to the direction of the carriage movement. The brush 63 is adapted to engage the knitting needles N, especially their latch sections, to pivot the latches onto the stem sections thereof and to similarly brake the yarn feeder 35.

Figure 4:
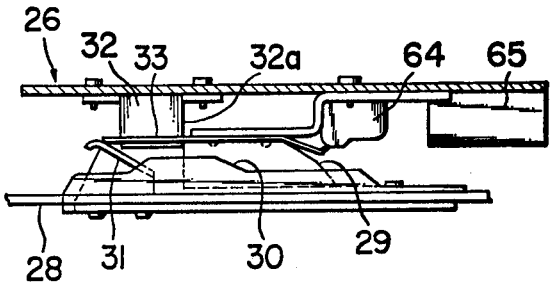
FIG. 4 is a cross-sectional view of the carriage shown in FIG. 1 taken along line IV—IV of FIG. 1.

The loop transfer devices 27, shown in FIGS. 1 and 4 and the corresponding front and rear loop transfer butt-paths X2 and X3, are theoretically or basically of the same construction as those disclosed in the aforementioned U.S. Pat. No. 3,412,582, and particularly with those of the embodiment illustrated in FIGS. 15 to 18 of that patent, although the embodiment of the present invention is accompanied by changes or modifications of parts and their arrangements for improving the loop transfer functions of the devices. Accordingly, the following description of the loop transfer devices 27 is simplified.

As shown in FIG. 4, each loop transfer device 27 includes a front needle lifter cam 29 mounted on the pressor plate 28. The lifter cam 29 includes an inclined camming edge that is adapted to engage with a forward end portion of a needle N of the first group which has its butt 16 conducted along the front loop transfer butt-path X2 to thereby lift the forward end portion of the needle above the top of the adjacent sinker element 34. A rear needle lifter cam 30, attached under the pressor plate 28 and extending upwardly through a slit (not shown) formed in the pressor plate 28 in a position rearwardly of the front needle lifter cam 29, is adapted to engage with a forward end portion of a needle N of the second group which has its butt 16 conducted along the rear loop transfer butt-path X3 to lift the needle near to the elevation of the top of the sinker element 34. A needle restorer cam 31, also mounted on the pressor plate 28, is located in front of an inner section of the rear needle lifter cam 30 and inside of and spaced from the front needle lifter cam 29. The needle restorer cam 31 includes an inclined cam edge adapted to enagage a front end portion of the needle N of the first group which has disengaged from the front needle lifter cam 29 to lift that needle for a second time above the top of the adjacent sinker element 34. As shown in the phantom line illustration of FIG. 1, the front and rear needle lifter cams 29 and 30 extend in a parallel spaced relationship with each other along the carriage 1.

Each loop transfer device 27 further includes a needle deflector cam 32 attached to the underside of the upper horizontal section of the support bracket 26. The needle deflector cam 32 extends in parallel relationship with and in front of an inner section of the rear needle lifter cam 30 and is located between the front needle lifter cam 29 and the needle restorer cam 31 in a direction along the length of the carriage 1. The needle deflector cam 32 has an outer vertical edge 32*a* (FIG. 4) which is substantially in alignment with and in front of the inner vertical edge of the front needle lifter cam 29 and adapted to engage with a forward end section of the needle that is lifted upwardly by the front needle lifter cam 29 to deflect the raised needle laterally beyond the adjacent sinker element 34 and beyond a forward end portion and hook of the adjacent needle N.

An elastic loop control plate 33 and an elastic latch opener 64 are also attached to the underside of the upper horizontal section of the support plate 26. The loop control plate 33 has a latching edge 33*a* (FIG. 1) extending askew relative to the length of the carriage 1 that is adapted to enter the space between the latch and the stem of the needle lifted by the front needle lifter cam 29 (which latch is in a position pivoted onto the stem of the needle) and to engage with a needle loop on the latch of the needle to hold the loop thereon and prevent it from being moved onto the stem of the needle from the latch. The latch opener 64 is positioned outwardly of the loop control plate 33 and is adapted to engage the latch of the needle that has been raised upward to an erected position by means of a conventional latch erecting device, such as a permanent magnet 65 attached to the underside of the upper horizontal section of the support bracket 26, to pivot the latch rearwardly onto the stem of the needle.

According to the loop transfer device 27 thus constructed and the cooperating loop transfer butt-paths X2 and X3 for bringing a "given pair" of needles into operative engagement with the loop transfer device 27 to effect a desired loop transfer operation, a needle loop is transferred, during movement of the carriage 1 in either direction of the needle bed 2, from a particular needle of the pair, which needle is selected by the needle selector member 3 and then caused to follow the front loop transfer butt path X2 while the needle loop is received by the next adjacent needle of the pair which is positioned to meet with the carriage 1 directly after the particular needle has met with the carriage 1; the particular needle and the adjacent next needle thus forming the "given pair" of needles and designated herein, respectively, as NF and NR.

Figure 5A:
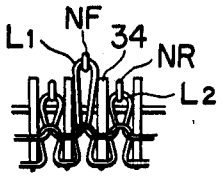
FIGS. 5*a* to 5*g* are illustrative front views of part of a needle bed, showing successive steps for transferring a needle loop from a first transferring needle to an adjacent receiving knitting needle of a needle pair.

More specifically, the particular or transferring needle NF selected by the selector member 3 and conducted into the front loop tranfer butt-path X2 during directional movement of the carriage 1 is first engaged at its front end portion by the inclined cam edge of the first front needle lifter cam 29 so that the front end portion of the needle (having thereon a needle loop L1 to be transferred) is lifted upwardly beyond the top of the adjacent sinker elements 34 as shown in FIG. 5*a*. The first loop control plate 33 then enters the space between the stem and the latch pivoted onto the stem of the needle NF (with the loop L1 on the latch) to displace the loop L1 forwardly as the now upwardly lifted needle NF is raised or advanced in the forward direction by the first separator cam 13 so that the loop L1 is retained on the latch of the needle NF, at a position P2 (FIG. 10) of the carriage 1. Concurrently, the adjacent next needle (which is hereinafter referred to as the "receiving" needle) not selected by the selector member 3 and conducted into the rear loop transfer butt-path X3 is first engaged at its forward end portion by the inclined cam edge of the first rear needle lifter cam 30 so that the front end portion of the receiving needle NR is lifted a little together with the needle loop L2 held in the hook of the needle NR. Thus at the position P2 of the carriage 1 relative to the needle bed 2, the selected transferring or particular needle NF has been forwardly raised by the first separator cam 13 with its front end portion lifted upwardly by the first front needle lifter cam 29 and the front end portion of the adjacent, non-selected receiving needle NR has been lifted upwardly to an elevation established by the first rear needle lifter cam 30.

Figure 5B:
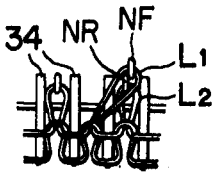
Figure 5C:
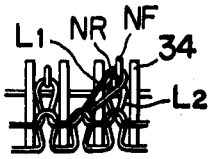

At the next position P3 (FIG. 1) of the carriage 1, the transferring or particular needle NF is contacted at its forward end portion by the vertical edge 32*a* of the first needle deflector cam 32 so that upon a further movement of the carriage 1 the forward end portion of the needle NF is laterally deflected against its own resiliency by the deflector cam 32 beyond the hook of the receiving needle NR causing the loop L1 to expand while the forward end portion of the receiving needle NR is further lifted by the first rear needle lifter cam 30 near to the level of the sinker elements 34. Thus, at the position P3 of the carriage 1, the hook of the receiving needle NR is substantially in registration or alignment with the expanded loop L1 on the deflected transferring or particular needle NF, as shown in FIG. 5*b*. With continued movement of the carriage 1, the particular needle NF is disengaged suddenly from the front needle lifter cam 29 and simultaneously from the needle deflector cam 32 and the loop control plate 33 so that it is received in the hook of the receiving needle NR in an intersecting relationship with each other whereafter the receiving needle NR is raised by the first rear cam 12 so that the hook of the receiving needle NR projects into and through the aligned needle loop L1. And then, the forward end portion of the receiving needle NR is moved down a little as determined by the profile of the first rear needle lifter cam 30 together with the particular needle NF thereon to a position as shown in FIG. 5*c*.

Figure 5D:
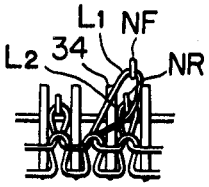
Figure 5E:
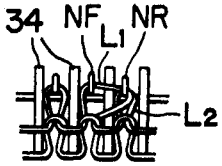
Figure 5F:
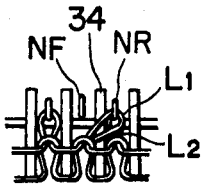

Subsequently, the forward end portion of the transferring or particular needle NF is engaged by the first needle restorer cam 31 and is lifted thereby above the level of the sinker elements 34, at position P4 of the carriage 1, so that it is disengaged from the receiving needle NR (FIG. 5*d*) and then restored to its initial, undeflected position by its own resiliency (FIG. 5*e*). The receiving needle NR is thereafter lowered beyond its knock-over position by the lowering cam means defined by the first intermediate cam 11, the swing cam or gate 15 and the outer lowering surface of the first inferior cam 17 whereupon the receiving needle NR catches the new loop L1 in the hook thereof and brings both loops L1 and L2 thereon rearwardly behind the row of the sinker elements 34 so that a portion of the loop L1 on the particular needle NF is displaced onto the stem of the particular needle from its pivoted latch, at a P5 position of the carriage 1. Then, the particular needle NF is also retracted beyond its own knock-over postion by the lowering cam means defined by the first front partition cam 10, the first front swing cam or gate 14 and the outwardly facing lowering cam edge 8*a* of the first superior cam 8 so that the loop L1 is knocked over from the particular needle NF to be held only by the receiving needle NR together with the loop L2, at a position P6 of the carriage 1, as shown in FIG. 5*f*, thus completing a sequency of operations transferring of a needle loop from one to the other of a given pair of knitting needles.

It is noted that those needles N which are not selected by the needle selector member 3 and yet have no selected companion needle to form a "given pair" of needles together with are also conducted into the rear loop transfer butt-path X3 and hence operated by the loop transfer device 27 in a similar manner with the receiving needle NR. Loop transfer, however, is not carried out with those needles N due to lack of a companion needle to form a "given pair". Accordingly, at the P6 position, those needles N have their own loops held in their hooks as they did before they were brought into operation by the carriage 1.

Figure 5G:
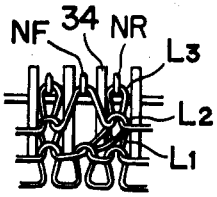

After completion of a loop transfer, both of the needles NF and NR are raised beyond their clearing position along the clearing butt-path X4 (defined by the inclined raising edge of the center cam 5, the gate 6, and the inner raising edge of the second superior cam 8) so that the loops L1 and L2 are displaced onto the stem of the receiving needle NR from the latch. A rotatably mounted round brush 69, similar to the brush 68, is provided on the pressor plate 60 to prevent needle loops from moving forwardly together with the needles being raised along the clearing butt-path X4. Both needles NF and NR are then lowered beyond their knock-over position along the knitting butt-path X5 whereupon a yarn 74 is fed onto both needles NF and NR and knit by the same, at a P7 position of the carriage 1, into new loops such as a new loop on the particular needle NF contiguous to adjacent loops and a new loop L3 on the receiving needle NR pulled through the dual loops L1 and L2, thus forming a laceform opening in the knitted fabric, as shown in FIG. 5*g*. On the other hand, those needles N with which no loop transfer has been carried out in the current row of knitting are also raised and lowered in a similar manner to knit the yarn fed thereto into needle loops such as a loop on the leftmost needle shown in FIG. 5*g*. The needles N are thereafter cleared of the carriage 1 without substantial or significant movement along their length and are normally positioned at a position indicated by the butt position B in FIG. 1.

Figure 6:
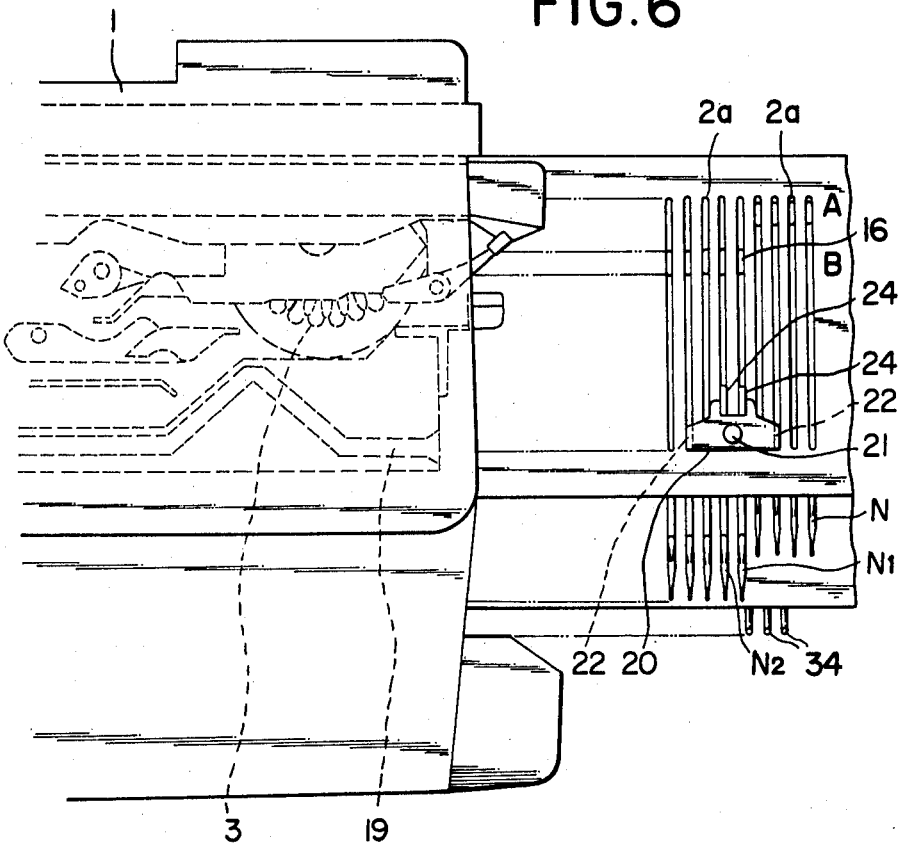
FIG. 6 is a fragmentary plan view of the needle bed and the carriage with selected parts shown in broken-line illustration and showing a needle lowering member mounted on the needle bed.
Figure 7:
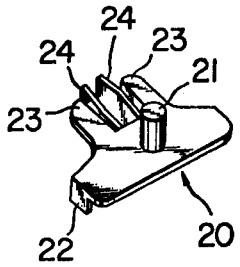
FIG. 7 is a perspective view of the needle lowering member shown in FIG. 6.
Figure 8:
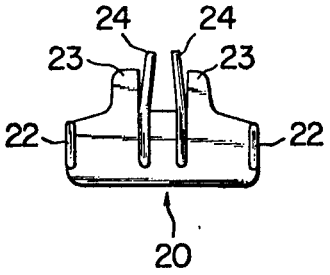
FIG. 8 is a bottom view of the needle lowering member shown in FIG. 7.

In order to prevent an undesirable deformation at either side edge of the knitted fabric due to the presence of an opening or openings, and especially to prevent drop stitches from appearing on either side edge of the knitted fabric during knitting operations, the hand-operated knitting machine according to the present invention includes means for conducting two operative end needles at either end of the range of operative knitting needles into the rear loop transfer butt-path X3 so that they cannot become the transferring or "particular" needles which have thereon needle loops to be transferred. The conducting means includes a pair of needle lowering members 20 (FIGS. 6 to 9) removably mounted at any needle position on the needle bed 2 and a camming member 18 (FIGS. 1 and 9) mounted on the carriage 1 for actuating the needle lowering members 20 into operation with one of the lowering members 20 being illustrated in FIGS. 7 and 8. Each lowering member is preferably made from a synthetic resin material and includes a cam-track following post 21 centrally secured to and extending upwardly from the top surface thereof. Each lowering member 20 has a pair of spaced apart depending legs 22 formed at opposite ends thereof and adapted to be inserted into needle tricks 2*a* formed in the needle bed 2 so as to allow the lowering member 20 to be placed at any desired needle position on the needle bed 2. The needle lowering member 20 is further provided, on the bottom thereof, with a pair of projections 24 adjacent to rear extensions 23 thereof and spaced apart from each other a distance substantially equal to that between two adjacent needle tricks 2*a*. The needle lowering member 20 is mounted on the needle bed with its legs 22 and its projections 24 fitted in needle tricks 2*a* in the needle bed 2, as seen from FIGS. 6 and 9, and normally positioned at the forwardmost limit of its range of movement with its legs 22 abutting the front ends of the needle tricks 2*a*, as shown in FIG. 6. The lowering member 20 thus mounted is movable rearwardly and forwardly along the needle tricks 2*a* into which the lowering member is inserted. The two projections 24 are slightly bent or inclined toward one another at their midportion to frictionally engage the edges of the needle bed 2 to prevent undesirable spontaneous movement of the lowering member 20 relative to the needle bed 2.

As shown in FIGS. 1 and 10, the camming member 18, which has heretofore referred to as the "front partition member," is provided with a channel-like cam track 19 adapted to receive the cam-track following post 21 of the needle lowering member 20 for moving the member 20 rearwardly and forwardly in a controlled manner with movement of the carriage 1 relative to the needle bed 2. The camming member 18 has a generally symmetrical construction relative to the transverse center line 7 of the carriage 1 and includes two pairs of lowering cam profiles 19*a* and raising cam profiles 19*b* for moving the needle lowering member 20 in the rearward and forward directions, respectively, of the needle bed 2.

In use, a pair of the lowering members 20 are mounted in position on the needle bed 2 at opposite ends of the range of the operative needles N, which operative needles are shown by the set of five forwardly extended needles N on the left in FIG. 6, the remaining four needles N being illustrated in their inoperative rearmost position A. In particular, each lowering member 20 is located at the forward, front end of the needle tricks 2*a* in a needle position in which the two projections 24 thereof are inserted in the needle tricks 2*a* for the two operative end needles as designated at N1 and N2 in FIG. 6.

During directional movement of the carriage 1, relative to the needle bed 2, the post 21 of either needle lowering member 20 is conducted into the cam track 19, and initially lowered or moved rearwardly by the first lowering cam profile 19*a* until its projections 24 extend between the first needle selector member 3 and the first separator cam 13 and rearwardly of a line extension from the rear edge of the first separator cam 13, at a P1 position of the carriage. During this rearward movement, the needle lowering member 20 pushes, at its two projections 24 the butts 16 of the two end needles N1 and N2 rearwardly beyond the just mentioned extension line even through the needles N1 and N2 may have been selectively displaced in the forward direction by the needle selector member 3. Thus, the butts 16 of both needles N1 and N2 will thereafter be conducted along the rear loop transfer butt-path X3, and needle loops will not be transferred from either one of these end needles N1 and N2. The needle lowering member 20 is then raised by the first raising cam profile 19*b*, which raising movement is not effective to raise the end needles N1 and N2 which are now controlled by those portions of the cam arrangement that define the rear loop transfer butt-path X3. The needle lowering member 20 is again lowered and then raised by the second lowering and raising cam profiles 19*a* and 19*b* of the cam track 19, respectively, which movements are also ineffective to move the end needles N1 and N2. Thus, during movement of the carriage 1 in either direction on the needle bed 2, the two end needles at either end of the range of operative needles are conducted into the rear loop transfer butt-path X3 so that they will knit plain stitches without any transfer of stitches or loops.

In order to knit a lace stitch on the hand-operated knitting machine according to the present invention, the required number of knitting needles N are brought into the operative position B while the remaining needles N are left in the inoperative rearmost position A, and a pair of the needle lowering members 20 are placed in position on the needle bed 2 in the tracks of the two endmost needles at both ends of the range of operative needles. Then, a knitting yarn 74 is appropriately threaded in the yarn feeder 35 and the center cam 5 is set in its operative position. After the program providing device 70 is properly set to provide a needle selection program which prescribes all the operative needles N not to be selected, the carriage 1 is slidably reciprocated on the needle bed 2 to knit several waste courses in a conventional manner. After completion of these preparations, a program carrier 71 for the desired lace stitch is set in position on the program device 70. A subsequently performed required number of reciprocations of the carriage 1 will knit the lace stitch.

Where two or more directional movements of the carriage 1 are required for a row or course of stitches, the center cam 5 is manually brought into its inoperative position to disable both clearing butt-paths X4 and the succeeding knitting butt-paths X5 and establish new butt-paths designated at X1; only one such butt-path X1 is shown in FIGS. 1 and 10. Thus, a directional movement of the carriage 1 with the cam 5 in its inoperative position will prevent the knitting of a new row of stitches and will carry out transfer of loops in accordance with the needle N selection.

Figure 11:
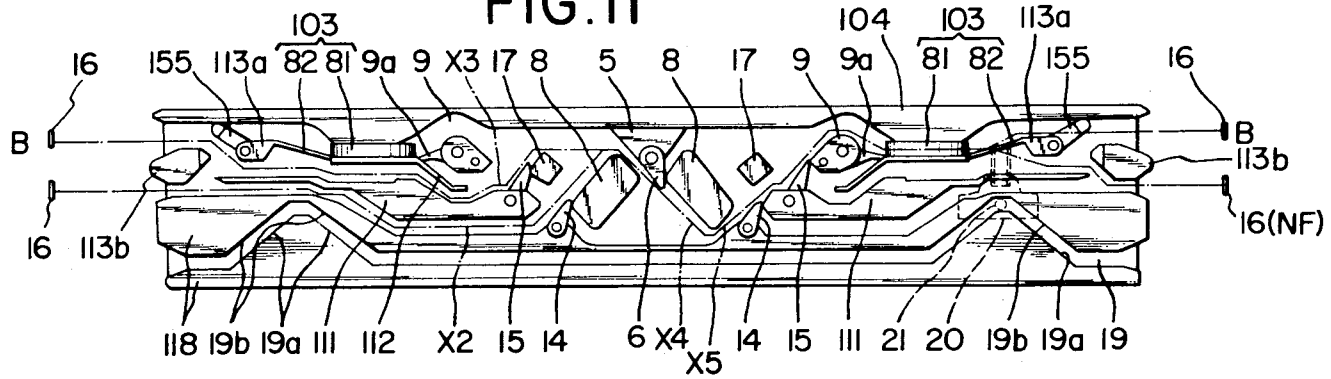
FIG. 11 is a bottom view, similar to that of FIG. 10 showing a second cam arrangement for the carriage.

A modified cam arrangement which is designed so that the needle selection pattern is left on the knitting needles, or, in other words, the knitting needles remain spearated as they were selectively operated by the needle selector member on the carriage is illustrated in FIG. 11, in which like parts are designated by like reference numerals as in the first embodiment. The modified cam arrangement includes a center cam 5, a center swing cam or gate 6, a pair of superior cams 8 and inferior cams 17, a pair of front swing or gate cams 14 and rear swing or gate cams 15, which are all similar to the corresponding ones of the first embodiment. The modified cam arrangement further includes a modified partition cam 104, a modified front partition member 118 formed as a single block consisting of the front partition member 18 and a pair of front partition cams 10 in the first embodiment, and a pair of modified intermediate cams 111 and rear cams 2.

A pair of modified needle selector members 103 are located outside of and adjacent to the auxiliary cams 9*a*. The needle selector members 103 are of a different known type used in combination with a plurality of known pattern plates (not shown) which are mounted in the needle bed below the needles with each having one or more needle retaining hook elements formed thereon. Each pattern plate is displaceable between an inoperative position and an operative position in which a hook element thereof retains a knitting needle at a depressed position, and a suitable known type of a program providing device controls the pattern plates. Each needle selector member 103 includes a depressor cam 81 adapted to depress knitting needles to a predetermined level into the needle bed 2. The depressed needle is thereafter retained in the depressed position if the corresponding pattern plate is in its operative position whereas it is restored in its initial upper position by a leaf spring 78 (FIG. 9) if the pattern plate is in its operative position. A selector cam 82, which is disposed askew in a position adjacent to and outside the depressor cam 81 and has an intermediate height, does not engage with the butts of the needles in their depressed position to thereby allow them to pass while it does engage with the butts of the needles in their initial upper position to lower them therealong. Thus, the depressor cam 81 and the selector cam 82 cooperate with the pattern plates to effect a desired needle selection in a manner analogous to the needle selecting member 3 of the first embodiment.

The needle butts selected by the selector member 103 are thereafter raised by first and then second separator cams 113*a* and 113*b* and then cleared of the carriage whereas the needle butts not selected push open a check cam 155 against the urging of a spring (not shown) to pass through the check cam 155 and clear the carriage thereafter, remaining in the B position. The pattern of the needle selection is thus left on the needle butts 16 after a pass of the carriage.

Upon a movement of the carriage in the reverse direction, the unselected rear needle butts 16 are first raised from the B position by the first check cam 155 to be conducted into the rear loop transfer butt-path X3 while the selected front needle butts 16 are conducted into the front loop transfer butt-path X2. The front and rear loop transfer butt-paths X2 and X3 and contiguous clearing butt-path X4 and knitting butt-path X5 are configured substantially the same as those of the first embodiment. Operations for knitting a lace stitch on the knitting machine with the modified cam arrangement of FIG. 11 are also substantially similar to those with the machine of the first embodiment, and hence a description thereof is omitted.

While the present invention has been described in reference to the preferred embodiment, it may be obvious that the carriage according to the present invention has a significantly smaller length than a carriage which is a mere combination of a conventional knitting carriage and a conventional loop transfer carriage. It may be readily understood by those skilled in the art that a needle selector cam mechanism on the carriage such as a selector drum 3 or a combination of a depressor cam 81 and a selector cam 82 requires, along the length of the carriage, a predetermined specific length which cannot be reduced. A loop transfer mechanism such as including a loop transfer device 27 and corresponding loop transfer butt paths X2 and X3, and a knitting cam mechanism such as defining a clearing butt-path X4 and a knitting butt-path X5 also require respective specific lengths along the length of the carriage. Thus, a mere combination of these mechanisms will require a length at least equal to the sum total of their specific lengths, which will cause the carriage to become excessively long and impracticable to use, with a length such as up to 50 cm, as indicated above. The problem is basically solved by the present invention by constituting the carriage such that a set of cam members defining first and second loop transfer butt-paths for one direction of movement of the carriage also define a clearing or raising butt-path and a contiguous knitting or lowering butt-path for the other direction of movement of the carriage so that both loop transfer butt-paths for the one direction intersect the knitting paths for the other direction. Preferably, a swing cam or gate, such as a center swing cam 6 is disposed at each of such intersecting points of the different butt-paths. Thus, it has been successfully found out that the carriage produced in accordance with the first embodiment of the present invention has a length, such as about 30 cm, substantially similar to a conventional knitting carriage currently being marketed.

While the present invention has been described in connection with the preferred embodiments, it is apparent to those skilled in the art that various changes and modifications can be made without departing from the spirit and scope of the invention as defined in the appended claims and their legal equivalent.

I claim:

1. In a hand-operated knitting machine of the type having a single flat needle bed including a plurality of knitting needles tricked for individual movement therein and a carriage mounted for sliding movement on the needle bed, each of the knitting needles having a butt thereon, the improvement comprising:

a pair of loop transfer devices located on said carriage in a symmetrical relationship with each other relative to the transverse center line of said carriage and cooperable with a given set of paired needles at the forward end portions thereof to transfer a particular needle loop from one to the other of the paired needles;

a yarn feeder mounted on said carriage and having an eye for feeding therethrough a knitting yarn onto said needles; and a cam arrangement mounted on said carriage for engagement with the butts of said needles to actuate said needles and having a generally symmetrical construction relative to said center line, said cam arrangement including a pair of needle selector members each located adjacent to an end portion of said carriage, a pair of cam member sets each located inwardly of an associated needle selector member in opposing relationship to an associated loop transfer device and each defining first and second loop transfer butt-paths for actuating, respectively, the needles selected by said needle selector members and the unselected remaining needles to bring the selected needles, as transferring needles and those of the unselected needles which are paired with the selected needles, as receiving needles, into operative engagement with said loop transfer devices to effect transfer of the particular needle loops from said selected transferring needle said unselected, paired, receiving needle of each needle pair, a center raising cam having a pair of cam profiles each defining part of a raising butt-path for raising both the selected and unselected needles to their clearing position, the raising butt-paths being contiguous to the respective first and second loop transfer butt-paths defined by the respective cam sets and intersecting each other at a point adjacent the forward angular end of the center raising cam, each set of said cams defining the remaining part of the corresponding raising butt-path, and a part of a lowering butt-path for lowering said needles from the clearing position to beyond the knock-over position, the lowering butt-path being contiguous to its respective raising butt-path, a knitting yarn being fed to the knitting needles while the needles are being lowered along said lowering butt-paths so as to be knit into needle loops by said needles, and a pair of knitting cams each located rearwardly of said first and second loop transfer butt-paths defined by the associated cam member sets for intersecting, in a first direction of movement of said carriage, one of said lowering butt-paths for the other direction of movement whereas said first and second butt-paths for the other direction of movement intersect the other lowering butt-path for said first direction of movement.

2. A hand-operated knitting machine as claimed in claim 1, wherein said cam arrangement includes swingable cams each located adjacent to an intersecting point of two different butt-paths and mounted for engagement by the butts of said needles to be swung between two positions in either of which it bridges two adjacent fixed cam members to partly define either of the two intersecting butt-paths.

3. A hand-operated knitting machine as claimed in claim 1, wherein said center raising cam is displaced between the initial position in which it establishes both of the raising butt-paths and a displaced position in which it abolishes said raising butt-paths and establishes for each direction of movement of said carriage an inoperative needle butt-path for holding said needles inoperative to the knitting yarn to be fed through said yarn feeder, each of the inoperative needle butt-paths being contiguous to the first and second loop transfer butt-paths and joining with the lowering butt-path at a position adjacent to the knitting cam.

4. A hand-operated knitting machine as claimed in claim 3, wherein said center raising cam has a swingable cam mounted for swinging motion about an axis fixed thereon between two abutted positions in which it bridges said center raising cam to the opposed fixed one of said sets of cam members so as to establish said raising butt-paths.

5. A hand-operated knitting machine as claimed in claims 1, 2, 3 or 4 further comprising a needle lowering member mounted removably on said needle bed at any one of a plurality of needle positions thereof and having a leg adapted to be tricked in a needle trick, and a camming means mounted on said carriage and having a guide-way formed therein in a symmetrical position relative to said transverse center line of said carriage, said needle lowering member further having a projection extending upwardly therefrom for engagement in said guide-way of said camming means on said carriage to be moved thereby in said needle trick to engage at said leg thereof with the particular needle in said needle trick to bring said particular needle positively into said second loop transfer butt-path thereby preventing a needle loop on said particular needle to be transferred therefrom.

6. A hand-operated knitting machine as claimed in claim 1, wherein said yarn feeder is mounted for limited slidable movement on said carriage between two end positions determined symmetrically relative to said transverse center line of said carriage as best appropriate for releasing through said eye thereof a knitting yarn to those knitting needles which are being lowered along said lowering butt-path of said carriage.

7. A hand-operated knitting machine as claimed in claim 6, wherein said carriage has a pair of guide rails mounted thereon in a parallel relationship with each other, and said yarn feeder has at least three rollers rotatably mounted thereon, two of said rollers being engaged with one of said guide rails while the remaining roller is engaged with the other of said guide rails to support said yarn feeder for movement along said guide rails.

8. In a hand-operated knitting machine of the type having a single flat needle bed including a plurality of knitting needles tricked for individual movement therein and a carriage mounted on the needle bed for sliding movement relative thereto in a first direction and in a second direction opposite from the first direction, each of the knitting needles having a butt thereon, the improvement comprising:

first and second loop transfer devices located on said carriage in a symmetrical relationship with each other relative to the transverse center line of said carriage and cooperable with a given pair of needles at the forward end portions thereof to transfer a particular needle loop from one to the other of said paired needles;

a yarn feeder mounted on said carriage and having an eye for feeding therethrough a knitting yarn onto said needle; and a cam arrangement mounted on said carriage for engagement with the butts of said needles to actuate said needles and having a generally symmetrical construction relative to said center line, said cam arrangement including first and second needle selector members each located adjacent to an end portion of said carriage for selecting needles, respectively, during movement of said carriage in said first direction and in said second direction, first and second cam member sets located, respectively, inwardly of said first and second needle selector members in opposing relationship to said first and second loop transfer devices, said first cam member set defining first and second loop transfer butt-paths for said first direction of movement of said carriage and said second cam member set defining first and second loop transfer butt-paths for said second direction of movement of said carriage, each of said first and second loop transfer butt-paths for their respective direction of movement actuating the needles selected by the associated needle selection member and the unselected remaining needles which are paired with the selected needle into operative engagement with the associated loop transfer device to effect transfer of the particular needle loops from said selected to said unselected paired needles, a center raising cam member having a pair of cam profiles each defining part of a first and a second raising butt-path that are contiguous to the first and second loop transfer butt-paths for the respective first and second directions of movement of said carriage, both raising butt-paths intersecting each other adjacent the forward angular end of said center raising cam, the remaining part of said first raising butt-path being defined by said second cam member set and the remaining part of said second raising butt-path being defined by said first cam member set, said second cam member set defining, contiguous to said first raising butt-path, part of a first lowering butt-path for lowering said needles from the clearing position to beyond the knock-over position, said first cam member set defining, contiguous to said second raising butt-path, part of a second lowering butt-path for lowering said needles from the clearing position to beyond the knock-over position, a knitting yarn being fed through said yarn feeder to the knitting needles when they are lowered along said first and said second lowering butt-paths so as to be knit into needle loops by said needles, first and second knitting cams located rearwardly, respectively, of said first and second loop transfer butt-paths for said first direction of movement and said first and second loop transfer butt-paths for said second direction of movement, said first knitting cam intersecting said second lowering butt-path during movement of said carriage in said second direction and said second knitting cam intersecting said first lowering butt-path during movement of said carriage in said first direction, said first and said second loop transfer butt-paths for said first direction of movement of said carriage intersecting said second lowering butt-path and said first and second loop transfer butt-paths for said second direction of movement of said carriage intersecting said first lowering butt-path.

* * * * *